US009849050B2

(12) United States Patent
McClean

(10) Patent No.: US 9,849,050 B2
(45) Date of Patent: Dec. 26, 2017

(54) WHEELCHAIR LIFT ASSEMBLY

(71) Applicant: Judie McClean, Mattapan, MA (US)

(72) Inventor: Judie McClean, Mattapan, MA (US)

( * ) Notice: Subject to any disclaimer, the term of this patent is extended or adjusted under 35 U.S.C. 154(b) by 0 days.

(21) Appl. No.: 15/052,991

(22) Filed: Feb. 25, 2016

(65) Prior Publication Data

US 2017/0246061 A1 Aug. 31, 2017

(51) Int. Cl.

| | |
|---|---|
| ***A61G 5/00*** | (2006.01) |
| ***A61G 5/14*** | (2006.01) |
| ***A61G 5/12*** | (2006.01) |

(52) U.S. Cl.

CPC ..... *A61G 5/14* (2013.01); *A61G 5/12* (2013.01); *A61G 2005/122* (2013.01); *A61G 2005/124* (2013.01); *A61G 2005/125* (2013.01)

(58) Field of Classification Search

CPC ..... A61G 5/14; A61G 5/12; A61G 5/00
See application file for complete search history.

(56) References Cited

U.S. PATENT DOCUMENTS

| | | | | |
|---|---|---|---|---|
| 2,748,834 | A | 1/1955 | Schwinn | |
| 3,990,745 | A | 11/1976 | Rodaway | |
| 4,477,117 | A | 10/1984 | Higgs | |
| D339,315 | S | 9/1993 | Lindkvist et al. | |
| 5,513,867 | A | 5/1996 | Bloswick et al. | |
| 5,556,121 | A * | 9/1996 | Pillot | A61G 5/14 180/907 |
| 5,772,226 | A * | 6/1998 | Bobichon | A61G 5/14 180/907 |
| 5,803,545 | A * | 9/1998 | Guguin | A61G 5/14 297/316 |
| 6,623,022 | B2 | 9/2003 | Malassigne et al. | |
| 7,055,840 | B1 | 6/2006 | Kelso | |
| 7,845,665 | B2 * | 12/2010 | Borisoff | A61G 5/02 280/250.1 |
| 8,556,347 | B2 * | 10/2013 | Lin | A61G 5/14 297/334 |
| 8,567,808 | B2 * | 10/2013 | Tholkes | A61G 5/14 280/47.4 |
| 8,636,298 | B2 | 1/2014 | Nimura | |
| 9,016,715 | B2 * | 4/2015 | Moliner | A61G 5/042 180/907 |
| 9,301,896 | B2 * | 4/2016 | Hsieh | A61G 5/14 |
| 2006/0048296 | A1 * | 3/2006 | Sutou | A61G 7/1007 4/667 |

* cited by examiner

*Primary Examiner* — Joseph M Rocca
*Assistant Examiner* — Michael R Stabley

(57) ABSTRACT

A wheelchair lift assembly includes a wheelchair. The wheelchair has a pair of seats and a frame. Each of the seats is hingedly coupled to the frame. Each of the seats is positionable in a stored position having each of the seats being horizontally oriented on the frame. Each of the seats is positionable in a lifted position having the each of the seats hinging upwardly from the upper front member. A lifting unit is coupled to the wheelchair. The lifting unit selectively urges each of the seats between the stored position and the lifted position. Thus, the lifting unit may lift a user thereby facilitating the user to exit the wheelchair.

6 Claims, 7 Drawing Sheets

WHEELCHAIR LIFT ASSEMBLY

BACKGROUND OF THE DISCLOSURE

Field of the Disclosure

The disclosure relates to lift devices and more particularly pertains to a new lift device for lifting a user out of a wheelchair.

SUMMARY OF THE DISCLOSURE

An embodiment of the disclosure meets the needs presented above by generally comprising a wheelchair. The wheelchair has a pair of seats and a frame. Each of the seats is hingedly coupled to the frame. Each of the seats is positionable in a stored position having each of the seats being horizontally oriented on the frame. Each of the seats is positionable in a lifted position having the each of the seats hinging upwardly from the upper front member. A lifting unit is coupled to the wheelchair. The lifting unit selectively urges each of the seats between the stored position and the lifted position. Thus, the lifting unit may lift a user thereby facilitating the user to exit the wheelchair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
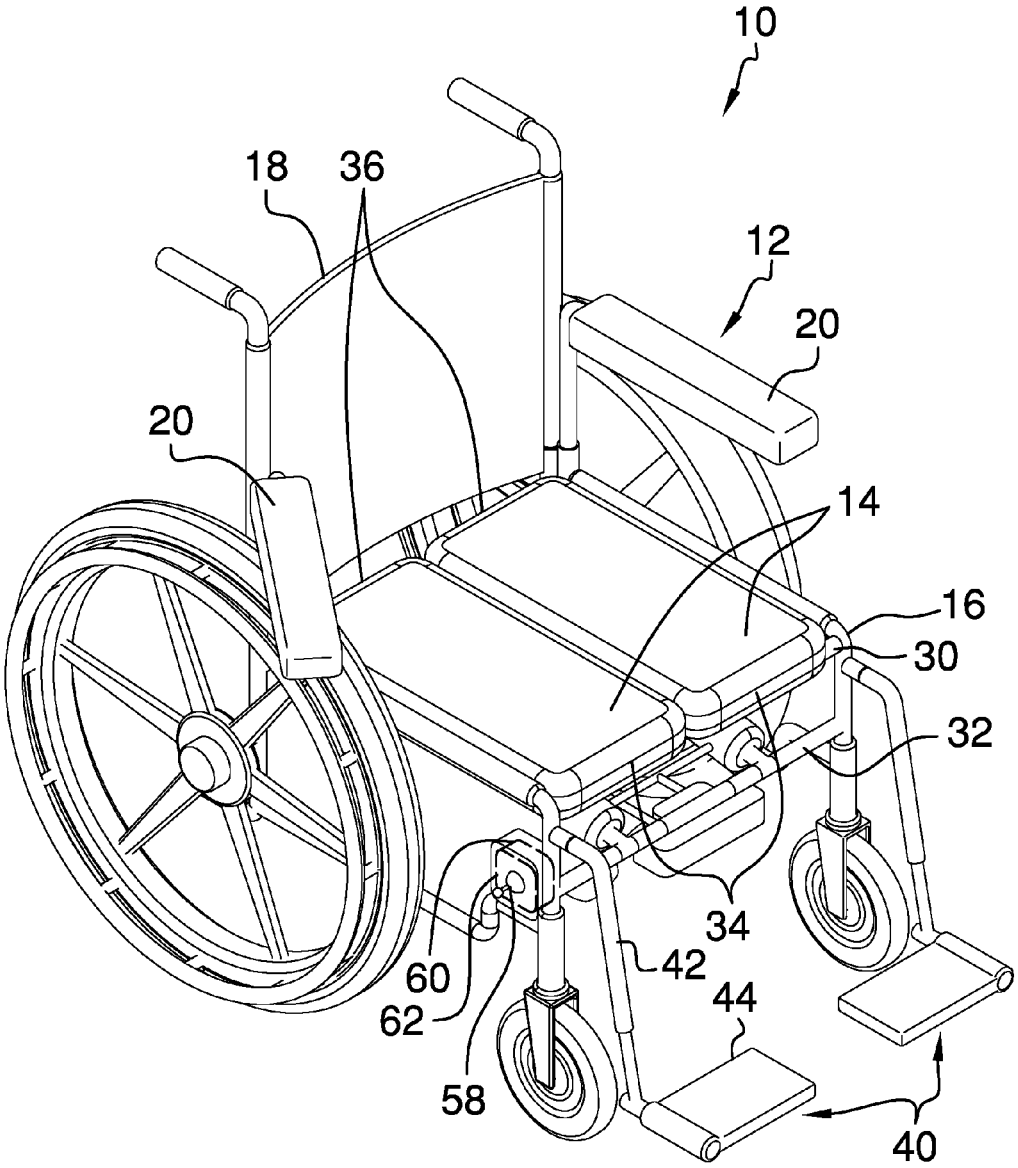
FIG. 1 is a top perspective view of a wheelchair lift assembly according to an embodiment of the disclosure.
Figure 2:
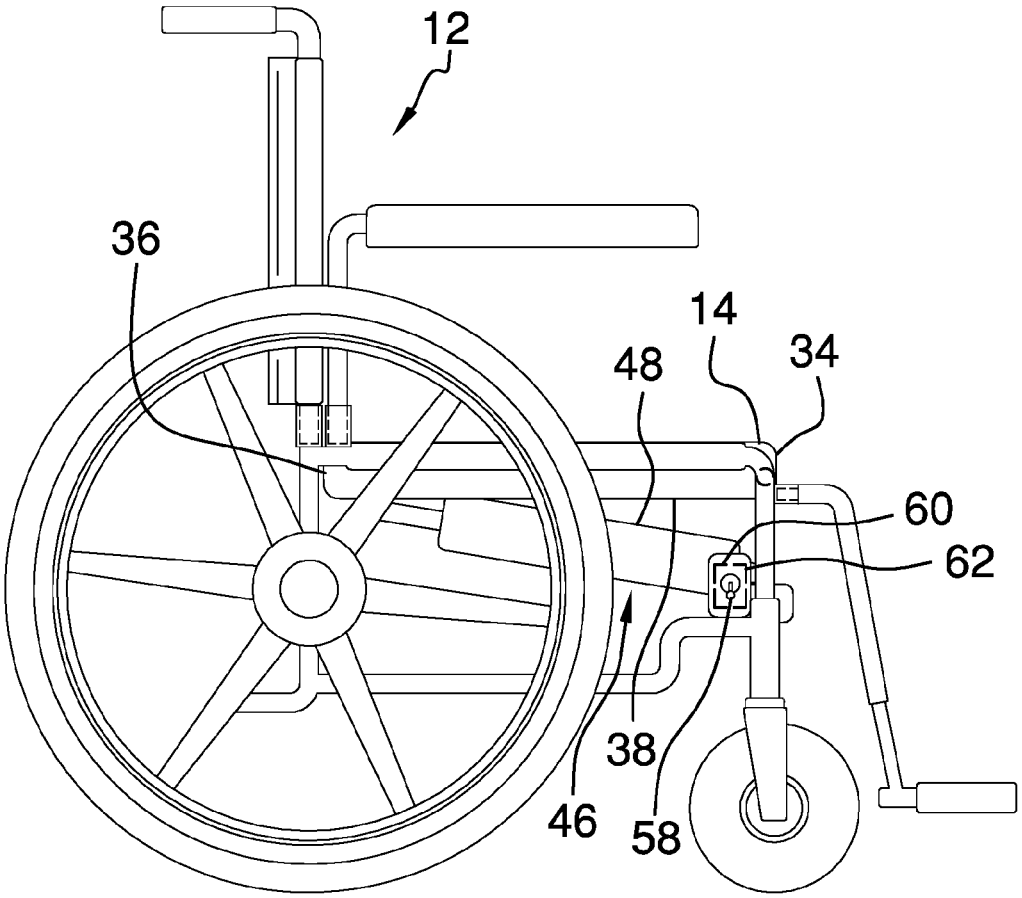
FIG. 2 is a right side view of an embodiment of the disclosure.
Figure 3:
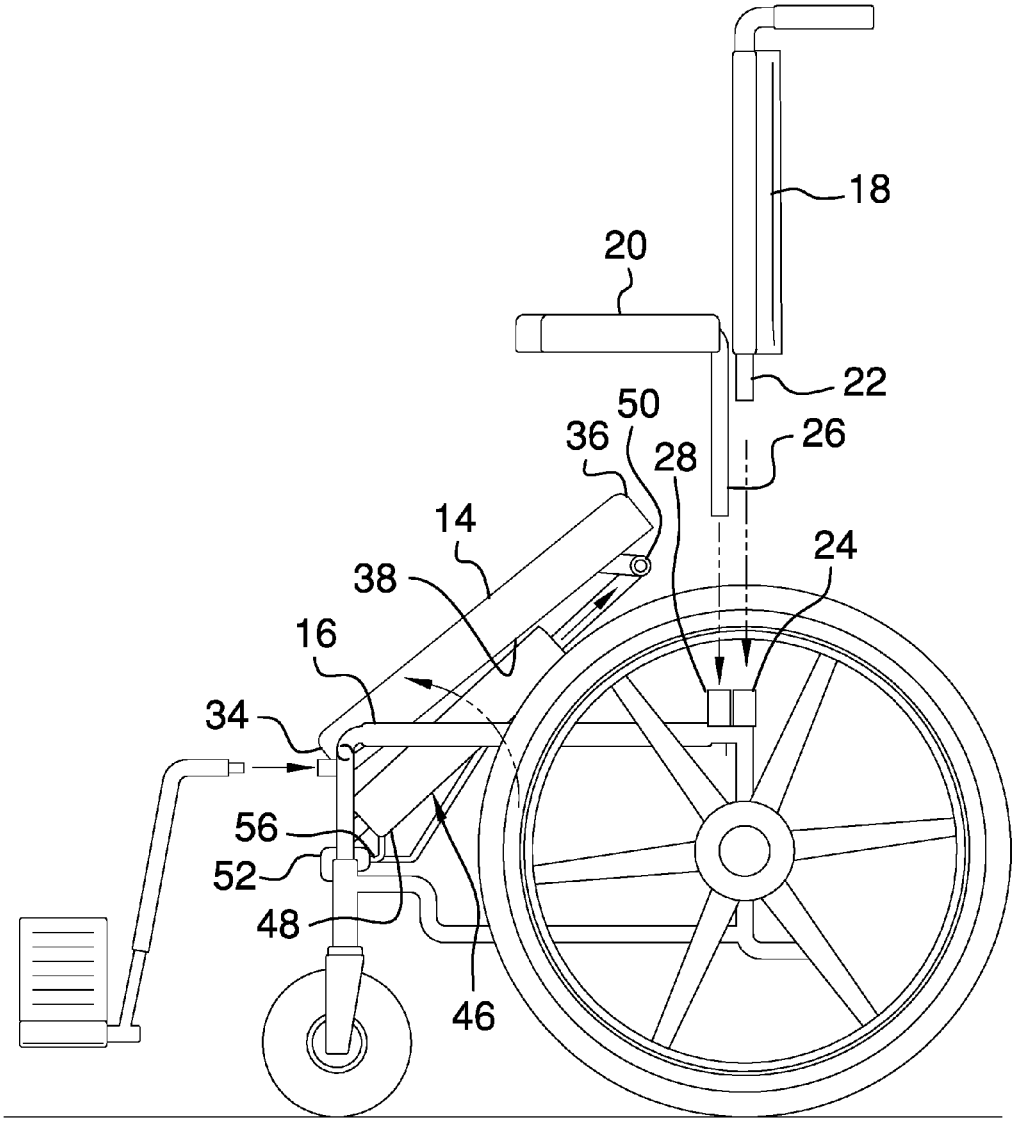
FIG. 3 is a left side in-use view of an embodiment of the disclosure.
Figure 4:
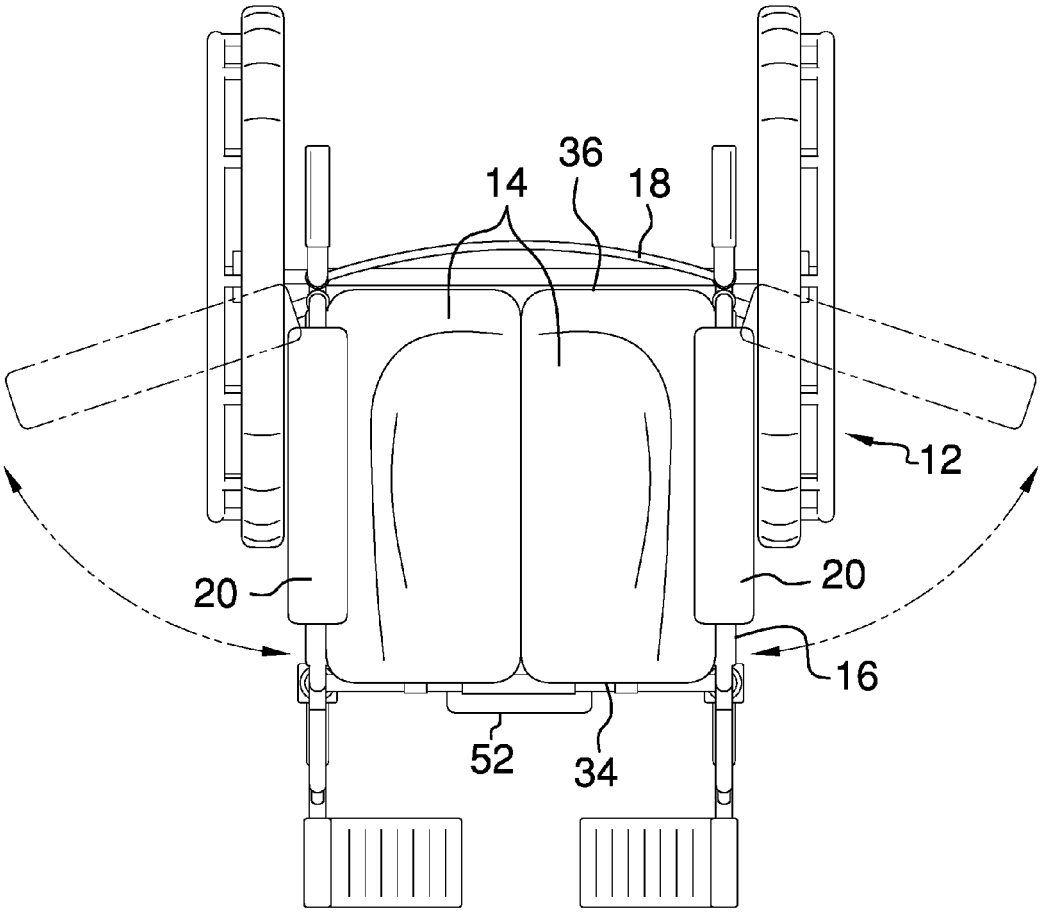
FIG. 4 is a top view of an embodiment of the disclosure.
Figure 5:
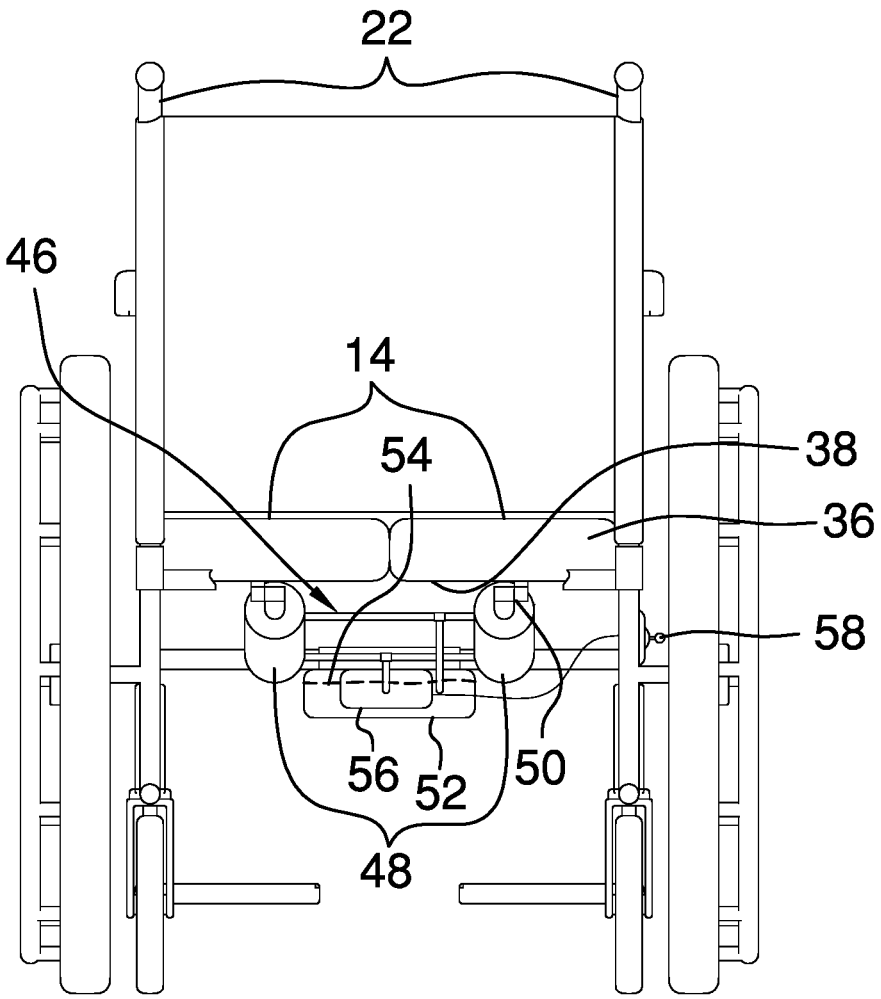
FIG. 5 is a back view of an embodiment of the disclosure.

With reference now to the drawings, and in particular to FIGS. 1 through 7 thereof, a new lift device embodying the principles and concepts of an embodiment of the disclosure and generally designated by the reference numeral 10 will be described.

As best illustrated in FIGS. 1 through 7, the wheelchair lift assembly 10 generally comprises a wheelchair 12 that may support a user. The wheelchair 12 has a pair of seats 14, a frame 16, a backrest 18 and a pair of arm rests 20. The backrest 18 is removably coupled to the frame 16. Each of the arm rests 20 is rotatably coupled to the frame 16. The backrest 18 may include a pair of pipes 22 that each slidably engages a pair of sleeves 24 on the frame 16. Each of the arm rests 20 may include a pair of shafts 26 that each slidably engages a pair of receivers 28 on the frame 16.

Each of the arm rests 20 may be positioned in a first position having each of the arm rests 20 being aligned with an associated one of the seats 14. Each of the arms rests 20 may be positioned in a second position having each of the arm rests 20 extending outwardly with respect to the associated seat 14. Each of the arm rests 20 is removable from the frame 16.

Each of the seats 14 is hingedly coupled to the frame 16. The frame 16 has an upper front member 30 and a lower front member 32. Each of the seats 14 has a front edge 34, a rear edge 36 and a bottom surface 38. The front edge 34 corresponding to each of the seats 14 is hingedly coupled to the upper front member 30 and the user may sit on each of the seats 14. Each of the seats 14 is positionable in a stored position having each of the seats 14 being horizontally oriented on the frame 16. Each of the seats 14 is positionable in a lifted position having each of the seats 16 hinging upwardly from the upper front member 30.

A pair of foot rests 40 is provided. Each of the foot rests 40 may include an arm 42 and a plate 44. The arm 42 corresponding to each of the foot rests 40 may slidably engage the frame 16. Thus, each of the foot rests 40 may be removably coupled to the wheelchair 12. The plate 44 corresponding to each of the foot rests 40 may support one of the user's feet.

A lifting unit 46 is coupled to the wheelchair 12 and the lifting unit 46 is operationally coupled to each of the seats 14. The lifting unit 46 selectively urges each of the seats 14 between the stored position and the lifted position. Thus, the lifting unit 46 may lift the user thereby facilitating the user to exit the wheelchair 12. The lifting unit 46 may assist the user to move between the wheelchair 12 and a bed.

The lifting unit 46 comprises a pair of pistons 48. Each of the pistons 48 may comprise a hydraulic piston or the like. Each of the pistons 48 is coupled between the lower front member 32 and the bottom surface 38 corresponding to an associated one of the seats 14. Each of the pistons 48 has a distal end 50 with respect to the lower front member 32. The distal end 50 corresponding to each of the pistons 48 is positioned adjacent to the rear edge 36 corresponding to the associated seat 14. Each of the pistons 48 urges the associated seat 14 into the lifted position having the rear edge 36 of the associated seat 12 being urged upwardly from the frame 16. Thus, each of the seats 14 may lift the user upwardly out of the wheelchair 12.

A reservoir 52 is coupled to the frame 16 and the reservoir 52 may contain a fluid 54. The fluid 54 may comprise hydraulic oil or the like. A pump 56 is coupled to the frame 16. The pump 56 is fluidly coupled between the reservoir 52 and each of the pistons 48.

The pump 56 selectively urges the fluid 54 from the reservoir 52 into each of the pistons 48. Thus, each of the pistons 48 urges the associated seat 14 into the lifted position. The pump 56 selectively draws the fluid 54 out of each of pistons 48 into the reservoir 52. Thus, each of the pistons 48 urges the associated seat 14 into the stored position. The pump 56 may comprise an electrically controlled hydraulic pump or the like.

A switch 58 is coupled to the frame 16 and the switch 58 may be manipulated. The switch 58 is electrically coupled to the pump 56. The switch 58 actuates the pump 56 to selectively position the seats 14 between the stored position and the lifted position. A power supply 60 is coupled to the frame 16. The power supply 60 is electrically coupled to the switch 58 and the power supply 60 comprises at least one battery 62.

Figure 6:
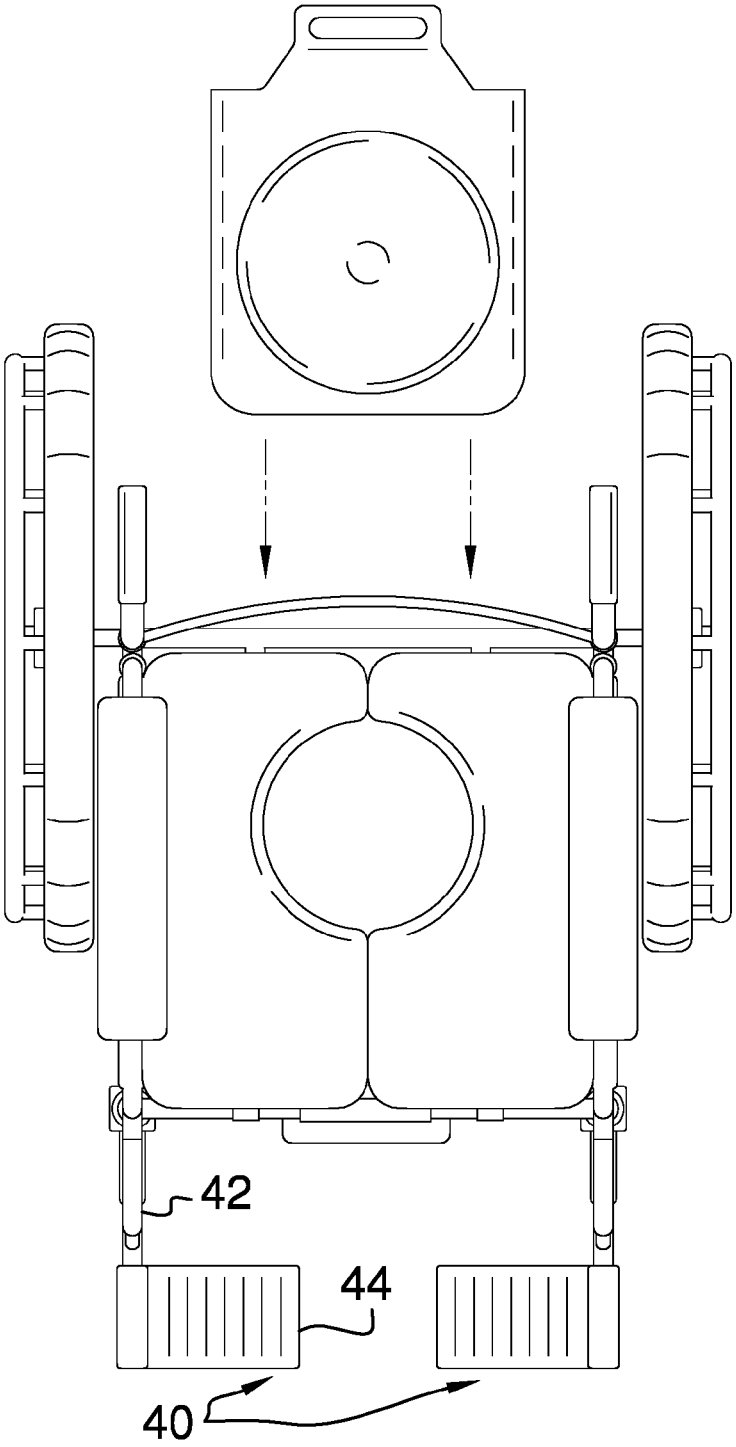
FIG. 6 is a top view of an alternative embodiment of the disclosure.
Figure 7:
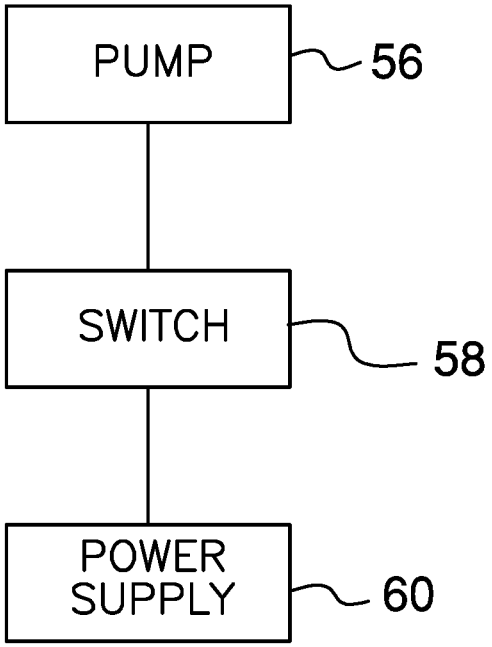
FIG. 7 is a schematic view of an embodiment of the disclosure.

In an alternative embodiment 64 as shown in FIG. 6, each of said seats 14 has an inwardly facing edge 66. The inwardly facing edge 66 corresponding to each of said seats 14 has a concavely arcuate portion 68. The concavely arcaute portion 68 corresponding to each of the seats 14 forms a circular opening 70 extending through the seats 14. A pan 72 is slidably positioned beneath the seats 14 and the pan 72 is aligned with the circular opening 70. Thus, the pan 72 may collect waste from the user when the user sits on the seats 14.

In use, the user sits on each of the seats 14 when each of the seats 14 is in the stored position. The wheelchair 12 facilitates the user to be mobile in the convention of wheelchairs 12. The switch 58 is manipulated to raise each of the seats 14 into the lifted position. Thus, user is lifted outwardly from the wheelchair 12 thereby reducing a chance of injury while the user exits the wheelchair 12. The user sits against the seats 14 when the seats 14 are in the lifted position. The switch 58 is manipulated to lower each of the seats 14 into the stored position. Thus, the user is lowered into the wheelchair 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wheelchair lift assembly being configured to lift a user up from a wheelchair, said assembly comprising:

a wheelchair being configured to support a user, said wheelchair having a pair of seats, a frame, a backrest and a pair of arm rests, said frame having an upper front member and a lower front member, said backrest being removably coupled to said frame, each of said arm rests being rotatably coupled to said frame, each of said arm rests being removable from said frame, each of said seats being hingedly coupled to said frame, each of said seats being configured to have the user sit thereon, each of said seats having a front edge, a rear edge and a bottom surface, said front edge corresponding to each of said seats being hingedly coupled to said upper front member, each of said seats being positionable in a stored position having each of said seats being horizontally oriented on said frame, each of said seats being positionable in a lifted position having said each of said seats hinging upwardly from said upper front member; and a lifting unit being coupled to said wheelchair, said lifting unit being operationally coupled to each of said seats, said lifting unit selectively urging each of said seats between said stored position and said lifted position wherein said lifting unit is configured to lift the user thereby facilitating the user to exit said wheelchair.

2. The assembly according to claim 1, wherein said lifting unit comprises a pair of pistons, each of said pistons being coupled between said lower front member and said bottom surface corresponding to an associated one of said seats, each of said pistons having a distal end with respect to said lower front member, said distal end corresponding to each of said pistons being positioned adjacent to said rear edge corresponding to said associated seat, each of said pistons urging said associated seat into said lifted position having said rear edge of said associated seat being urged upwardly from said frame wherein each of said seats is configured to lift the user upwardly out of said wheelchair.

3. A wheelchair lift assembly being configured to lift a user up from a wheelchair, said assembly comprising:

a wheelchair being configured to support a user, said wheelchair having a pair of seats, a frame, a backrest and a pair of arm rests, said frame having an upper front member, said backrest being removably coupled to said frame, each of said arm rests being rotatably coupled to said frame, each of said arm rests being removable from said frame, each of said seats being hingedly coupled to said frame, each of said seats being configured to have the user sit thereon, each of said seats being positionable in a stored position having each of said seats being horizontally oriented on said frame, each of said seats being positionable in a lifted position having said each of said seats hinging upwardly from said upper front member; and a lifting unit being coupled to said wheelchair, said lifting unit being operationally coupled to each of said seats, said lifting unit selectively urging each of said seats between said stored position and said lifted position wherein said lifting unit is configured to lift the user thereby facilitating the user to exit said wheelchair;

a pair of pistons, each of said pistons being coupled between said frame and an associated one of said seats;

a reservoir being coupled to said frame, said reservoir being configured to contain a fluid; and a pump being coupled to said frame, said pump being in fluid communication between said reservoir and each of said pistons, said pump selectively urging the fluid from said reservoir into each of said pistons such that each of said pistons urges said associated seat into said lifted position, said pump selectively drawing the fluid out of each of pistons into said reservoir such that each of said pistons urges said associated seat into said stored position.

4. The assembly according to claim 3, further comprising a switch being coupled to said frame wherein said switch is configured to be manipulated, said switch being electrically coupled to said pump such that said switch actuates said pump to selectively position said seats between said stored position and said lifted position.

5. The assembly according to claim 4, further comprising a power supply being coupled to said frame, said power supply being electrically coupled to said switch, said power supply comprising at least one battery.

6. A wheelchair lift assembly being configured to lift a user up from a wheelchair, said assembly comprising:

a wheelchair being configured to support a user, said wheelchair having a pair of seats, a frame, a backrest and a pair of arm rests, said backrest being removably coupled to said frame, each of said arm rests being rotatably coupled to said frame, each of said arm rests being removable from said frame, each of said seats being hingedly coupled to said frame, said frame having an upper front member and a lower front member, each of said seats having a front edge, a rear edge and a bottom surface, said front edge corresponding to each of said seats being hingedly coupled to said upper front member, each of said seats being configured to have the user sit thereon, each of said seats being positionable in a stored position having each of said seats being horizontally oriented on said frame, each of said seats being positionable in a lifted position having said each of said seats hinging upwardly from said upper front member; and a lifting unit being coupled to said wheelchair, said lifting unit being operationally coupled to each of said seats, said lifting unit selectively urging each of said seats between said stored position and said lifted position wherein said lifting unit is configured to lift the user thereby facilitating the user to exit said wheelchair, said lifting unit comprising:

a pair of pistons, each of said pistons being coupled between said lower front member and said bottom surface corresponding to an associated one of said seats, each of said pistons having a distal end with respect to said lower front member, said distal end corresponding to each of said pistons being positioned adjacent to said rear edge corresponding to said associated seat, each of said pistons urging said associated seat into said lifted position having said rear edge of said associated seat being urged upwardly from said frame wherein each of said seats is configured to lift the user upwardly out of said wheelchair, a reservoir being coupled to said frame, said reservoir being configured to contain a fluid, a pump being coupled to said frame, said pump being in fluid communication between said reservoir and each of said pistons, said pump selectively urging the fluid from said reservoir into each of said pistons such that each of said pistons urges said associated seat into said lifted position, said pump selectively drawing the fluid out of each of pistons into said reservoir such that each of said pistons urges said associated seat into said stored position, a switch being coupled to said frame wherein said switch is configured to be manipulated, said switch being electrically coupled to said pump such that said switch actuates said pump to selectively position said seats between said stored position and said lifted position, and a power supply being coupled to said frame, said power supply being electrically coupled to said switch, said power supply comprising at least one battery.

* * * * *